US005846337A

United States Patent [19]

Uchinami et al.

[11] Patent Number: 5,846,337

[45] Date of Patent: Dec. 8, 1998

[54] AERIAL WASHING METHOD AND APPARATUS

[75] Inventors: Toshiro Uchinami; Tadao Nishikawa, both of Tokyo, Japan

[73] Assignee: Toyo Uchinami Techno Clean Co., LTD., Tokyo, Japan

[21] Appl. No.: 662,411

[22] Filed: Jun. 10, 1996

[30] Foreign Application Priority Data

Jun. 9, 1995 [JP] Japan ..... 7-167936

[51] Int. Cl.[6] ..... B08B 3/00

[52] U.S. Cl. ..... 134/34; 134/21; 134/37; 239/8; 239/101

[58] Field of Search ..... 134/21, 34, 37; 239/8, 101

[56] References Cited

U.S. PATENT DOCUMENTS 4,792,096 12/1988 Gregory ..... 239/113

*Primary Examiner*—Kriellion S. Morgan

*Attorney, Agent, or Firm*—Jacobson, Price, Holman & Stern, PLLC

[57] ABSTRACT

An aerial washing method for obtaining washing effects almost equal to those of underwater washing is embodied. An jet opening 12 for jetting high-pressure water in a direction generally parallel to the direction the nozzle's axis is provided in a nozzle port 11 of a washing nozzle 10, and a negative pressure is formed in the nozzle port 11 by jetting a high-pressure water jet. A low-pressure water inlet 14 and a gas inlet 15 through which low-pressure water and a gas, respectively, are sucked in using this negative pressure are provided in the washing nozzle 10. The low-pressure water and the gas are engulfed in the high-pressure water jet, and the resultant high-pressure jet of water is aerially directed against an object to wash it.

6 Claims, 4 Drawing Sheets

AERIAL WASHING METHOD AND APPARATUS

FIELD OF THE INVENTION

The present invention relates to an aerial washing method and device for washing an object set into an aerial washing position, by jetting a washing liquid mainly comprising water.

DESCRIPTION OF THE PRIOR ART

Various washing solvents and agents including organic solvents have been used in the field of industrial washing in which articles with adhering machine oil, fats and oils, or dirt consisting of oil, dust, and various other components must be washed. In view of the increasingly noticeable destruction of the environment, the inventor has developed techniques for washing objects using only water instead of noxious washing agents. Some of these results have been submitted for patent and published.

These water-washing methods and devices mainly involve the washing of objects in washing water to prevent some parts thereof being left unwashed. Such underwater washing, however, requires additional costs due to the need for watertight structures and waterproof facilities. As a result, although the advantages of the underwater washing method have been appreciated, the use of underwater washing devices has often been limited due to their expense.

SUMMARY OF THE INVENTION

This invention is adapted to address the above point, the objective is to aerially jet against an object a washing liquid mainly comprising water, without immersion of the object in washing water, in order to obtain the same washing effects obtained in underwater washing.

To solve the above problem, this invention provides an aerial washing method for jetting a fluid comprising a mixture of a washing liquid and a gas against an object through washing nozzles, a method that installs a high-pressure water jet opening in a nozzle port of the washing nozzle and uses high-pressure water jet to generate a negative pressure in the nozzle port in order to use this negative pressure to suck low-pressure water and a gas into the nozzle port through low-pressure water and gas inlets provided in the same nozzle port, thereby engulfing the low-pressure water and the gas in a high-pressure water jet to form a high-pressure jet of water which is then applied against the object to be washed.

The aerial washing method is preferably implemented by an aerial washing device that applies to the object a liquid comprising a mixture of a washing liquid and a gas, comprising a high-pressure jet pipe installed in the nozzle port of the washing nozzle and having a jet opening that jets high-pressure water in a direction generally parallel to the direction of the nozzle axis to apply a negative pressure within the nozzle port; and inlets for low-pressure water and a gas provided in the washing nozzle through which low-pressure water and a gas are sucked into the nozzle port, which is maintained at negative pressure.

The washing liquid mainly comprising water, as used herein, is basically composed of water. For objects that may experience rusting due to water washing, however, the washing liquid may be mixed with a preservative. In addition, a washing agent that is obviously non-noxious and safe, for example, a kind of alkali detergent may be used as required.

In the aerial washing method according to this invention, since high-pressure water is jetted from a jet opening 12 installed in a nozzle port 11 of a washing nozzle 10, as shown in FIG. 1, the inside of the nozzle port 11 may be properly maintained at a high level negative pressure, which may be used as suction force to introduce low-pressure water and an air current through the nozzle port 11, thereby causing the low-pressure water and the gas to be engulfed in high-pressure water. This water is jetted against an object as a high-pressure jet of water having high kinetic energy.

The high-pressure water jet, jetted from the washing nozzle 10, collides against the object to form a central washing region A within which dirt sticking to the object is released and a peripheral washing region B, extending over a certain range around the central washing region A, which is created by the high-pressure irregular reflection of the high-pressure water jet upon its strong collision against the object (FIG. 2). In the region B, this irregularly reflected fluid moves along the surface of the object to cause rapid interfacial floating, thereby also acting as a washing force.

Thus, relative movement between the position of the washing nozzle and the surface of the object causes washing in the peripheral washing region B, overlapped by the central washing region A, resulting in significantly improved washing force. If the effective washing distance from the washing nozzle 10 when high-pressure water is simply jetted therefrom is labeled as D, this invention can increase the effective washing distance by about 50%.

DETAILED DESCRIPTION OF PREFERRED EMBODIMENTS

Figure 1:
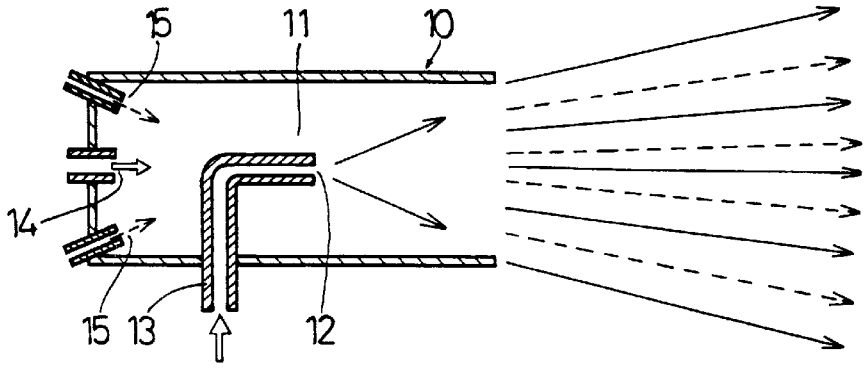
FIG. 1 describes a first embodiment of an aerial washing method according to this invention.
Figure 2:
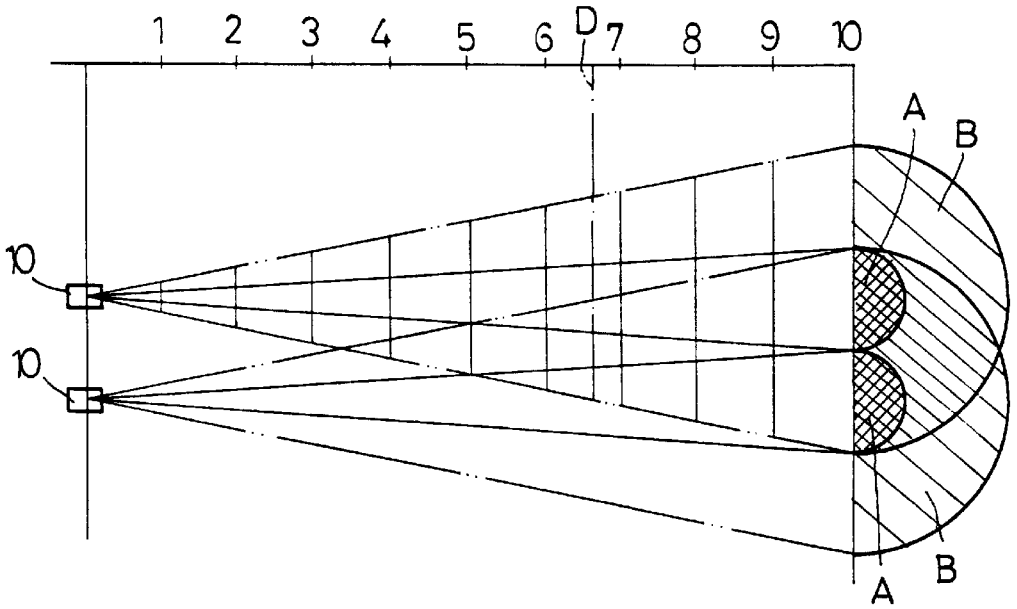
FIG. 2 describes the effects of this method.

FIG. 1 describes a washing nozzle 10 in an aerial washing method according to this invention. In this figure, reference numeral 11 designates a nozzle port; 12 is a high-pressure water jet opening; 14 is a low-pressure water inlet; and 15 is a gas inlet.

The washing nozzle 10 jets a fluid (the "high pressure jet of water") comprising a mixture of a washing liquid and a gas from the tip of the nozzle port 11 in the direction of the nozzle axis, and inlets 14, 15 are provided at the proximal end of the illustrated nozzle 10. A single jet opening 12 as illustrated is provided at the center of, for example, a cylindrical nozzle 10, and high-pressure water is jetted from the jet opening 12 to form a negative pressure section around the opening 12 within the nozzle port 11.

The high-pressure water jet opening 12 is the tip of a jet pipe 13 for jetting high-pressure water introduced into the jet nozzle 10, and the direction of this high-pressure jet of water is aligned with the direction of the nozzle axis. As used herein, the "pressure" of the high-pressure water, refers to a jet pressure of at least several tens of kg/cm$^2$, and ordinarily up to 150 to 200 kg/cm$^2$. Depending on the object or the amount of dirt, however, a very high pressure of 500 to 1,000 kg/cm$^2$ may be used. "Water," as used herein, includes any water heated to above room temperature.

A low-pressure water inlet 14 and a gas inlet 15 are both disposed at the proximal end of the washing nozzle 10, and in this case, are directed in the direction of nozzle axis or in this general direction. If air is used as the gas introduced from the gas inlet 15, the inlet 15 only need connect the outside of the washing nozzle to the inside thereof. The low-pressure water is subject to a pressure of zero to that relative to water-supply water, and the gas may be air.

When high-pressure water is jetted from the jet opening 12, the water is jetted from the nozzle port 11, while a negative pressure is formed within the nozzle port 11. This negative pressure causes low-pressure water and air to be sucked through the low-pressure water inlet 14 and the gas inlet 15, respectively. The low-pressure water and the air are engulfed in the high-pressure water, which then becomes a high-pressure jet of water and reaches the surface of an object, colliding hard against it to form a central washing region A and simultaneously a peripheral washing region B that is concentric around the region A and which involves interfacial floating.

A washing liquid may be sprayed from above the object in the form of a shower, while the washing nozzle 10 may be simultaneously used to execute the above washing. This makes the object sufficiently wet and increases the amount of water that contributes to the washing, thereby improving the washing performance. The aerial washing method mainly employing water has been described so far.

To give an example, when high-pressure water was jetted from the jet opening 12 at a flow rate of 40.3 l/min. and a jet pressure of 80 kg/cm$^2$, low-pressure water and air were drawn in using negative pressure, without increasing or reducing their pressure, and the high-pressure jet of water thus formed was jetted. A central washing region A about 200 mm in diameter was then formed on a surface located at a distance of 1,000 mm from the washing nozzle 10 and perpendicular thereto. A pressure of about 1.0 kg was applied to region A, with a peripheral washing region B about 500 mm in diameter formed around this region. When this high-pressure jet of water was jetted against different objects with significantly different shapes and types of dirt, satisfactory washing effects were obtained for all the types of dirt.

Figure 8:
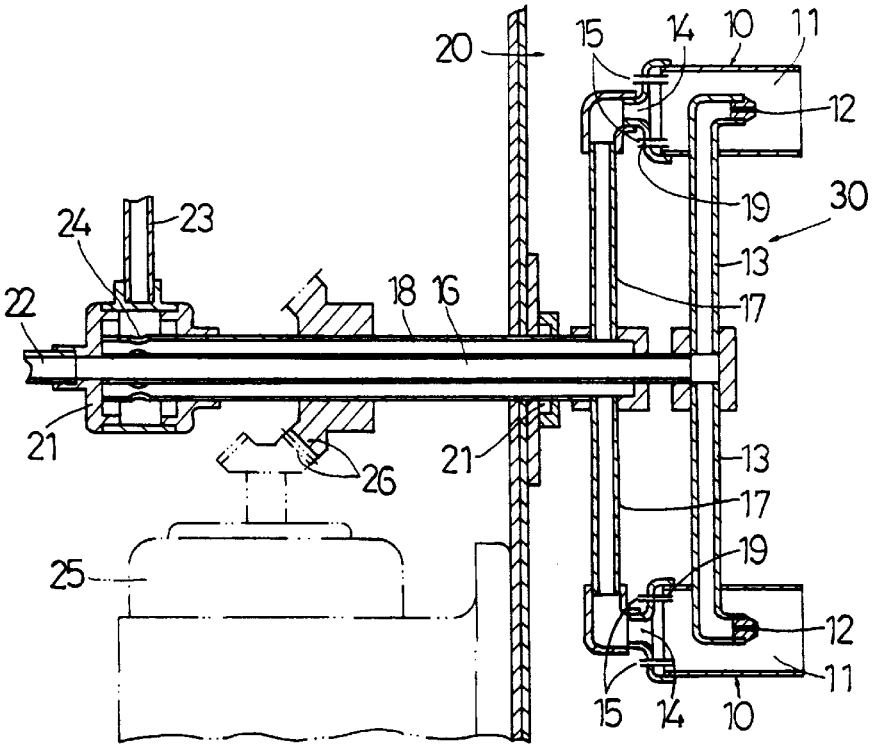
FIG. 8 is a cross-sectional view of a rotary washing nozzle employed for this invention.

An example of an aerial washing device that implements the aerial washing method according to this invention is described below. This device employs a rotary washing nozzle 30 with a structure as shown in FIG. 8.

The rotary washing nozzle 30 has washing nozzles 10 attached to the tips of several high-pressure water jet pipes 13 radially provided around a rotation shaft 16. A washing liquid passes through the cylindrical rotation shaft 16, which is also used as a high-pressure water supply path, and the high-pressure water jet pipe 13, and is then jetted from the jet opening 12 to the outside of the nozzle port 11.

The rotation shaft 16 is integrated with a low-pressure water supply path 18 provided outside thereof as a double cylinder, and has several low-pressure water paths 17 radially extending from the tip thereof, as in the washing nozzle. The tip of the low-pressure water path 17 is opened at the proximal end of the washing nozzle 10 as a low-pressure water inlet 14 that faces the tip of the washing nozzle 10.

A plurality of air inlets 15 are disposed at the proximal end of the washing nozzle 10, and the illustrated air inlets are pipes connecting the outside of the washing nozzle 10 to the inside thereof. The external end of the pipe 19 has good air intake characteristics when, for example, bent to the direction of rotation. Reference numeral 20 is an aerial washing chamber; 21 is a bearing for rotation shafts (16, 18); 22 is a high-pressure water piping; and 23 is a low-pressure water piping. Low-pressure water is supplied from, for example, a passage port 24 opened in the low-pressure water supply path 18. Reference numeral 25 denotes a driving source for rotating the nozzles, shown as a motor, and 26 is a transmission means comprising a gear that couples the rotations shafts (16, 18) to the driving source 25.

Figure 3:
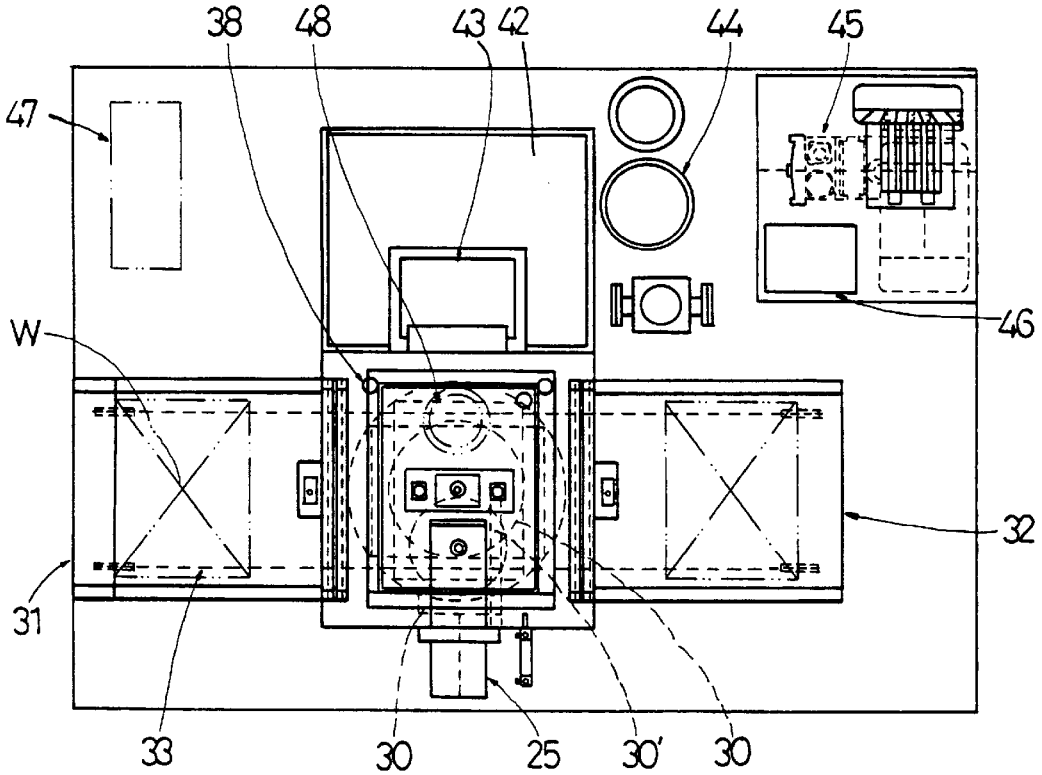
FIG. 3 is a plan showing a first embodiment of an aerial washing device according to this invention.
Figure 4:
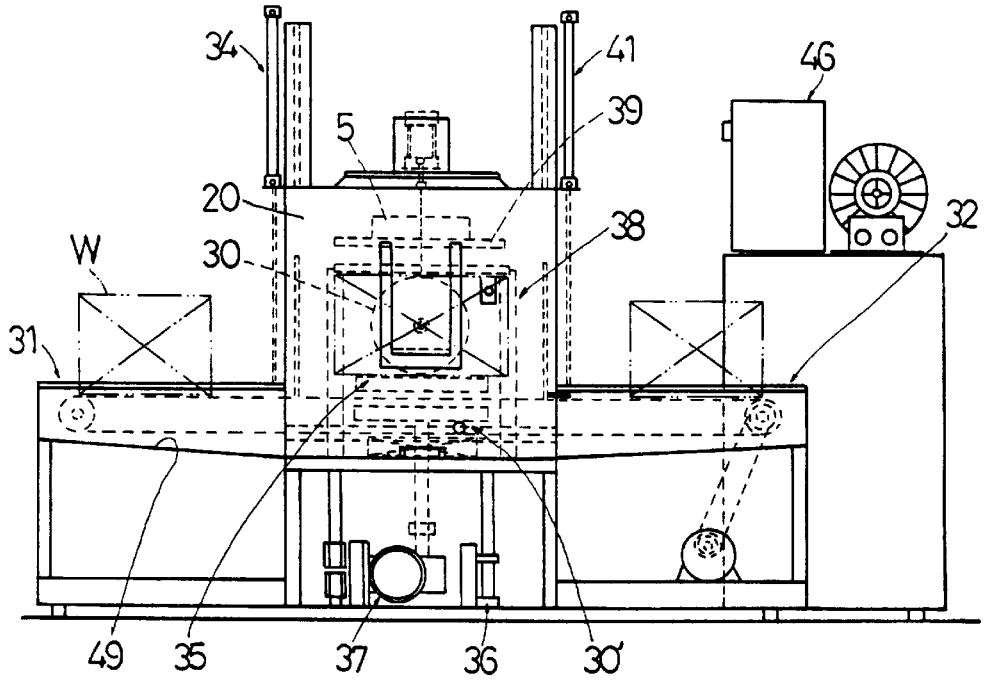
FIG. 4 is a front view of FIG. 3.

A first embodiment of an aerial washing device employing this rotary washing nozzle 30 is described in conjunction with FIGS. 3 and 4. This embodiment is of a single chamber type with a single aerial washing chamber 20, before and after which an inlet section 31 and an outlet section 32 are disposed, respectively, wherein an object W is transferred from the inlet section 31 by a transfer means 33 comprising conveyor into the aerial washing chamber 20 through a closing door 34, and wherein once the object reaches a washing position in the chamber, a rotatable support board 35 is elevated by an elevating means 36 and the object is set thereon. Reference numeral 37 denotes a rotationally driving source for the support board 35.

The rotary washing nozzle 30 according to this invention is provided on both the top and the side surfaces, and after setting, an aerial washing lower fixed nozzle 30' also jets a high-pressure jet water of from below the object. Furthermore, aerial washing and rinsing fixed nozzles 38 laterally jet washing and rinsing water against the objected located in this position.

Reference numeral 39 indicates a presser that presses the object from above; 41 is a closing door on the outlet side; 42 is a circulating tank for a washing liquid for the aerial washing section; 43 is a filter for the circulating tank; 44 is an oil-separating device for filtering washing water; and 45 is an aerial washing pump for jetting high-pressure water. Reference numeral 46 designates a hot air generator for jetting hot air against the object during the centrifugation for dehydrating caused by the rotation of the support board 35. This generator works to dewater and dry the object immediately after washing. Reference numeral 47 denotes a control panel, 48 is an exhaust gas port; and 49 is the bottom of a washing liquid collecting case.

Once an object W such as a small mechanical part contaminated with fat or oil has been placed in a basket and set into a washing position in the device, as shown in FIGS. 3 and 4, the device elevates it from a transfer path, and jets a high-pressure jet of water from the rotating washing nozzles 30 to wash the object. In this case, the high-pressure jet of water is jetted from variable positions by the rotation of the rotary washing nozzles 30 disposed at the bottom and on the sides. The lower fixed nozzle 30' also jets a high-pressure jet of water. The object is thus subjected to rapid high-pressure water jets from every direction. The rotation of the object allows no surface thereof to remain unwashed, and thus enables the washing of these parts of the object which conventional aerial washing methods would fail to wash.

Figure 5:
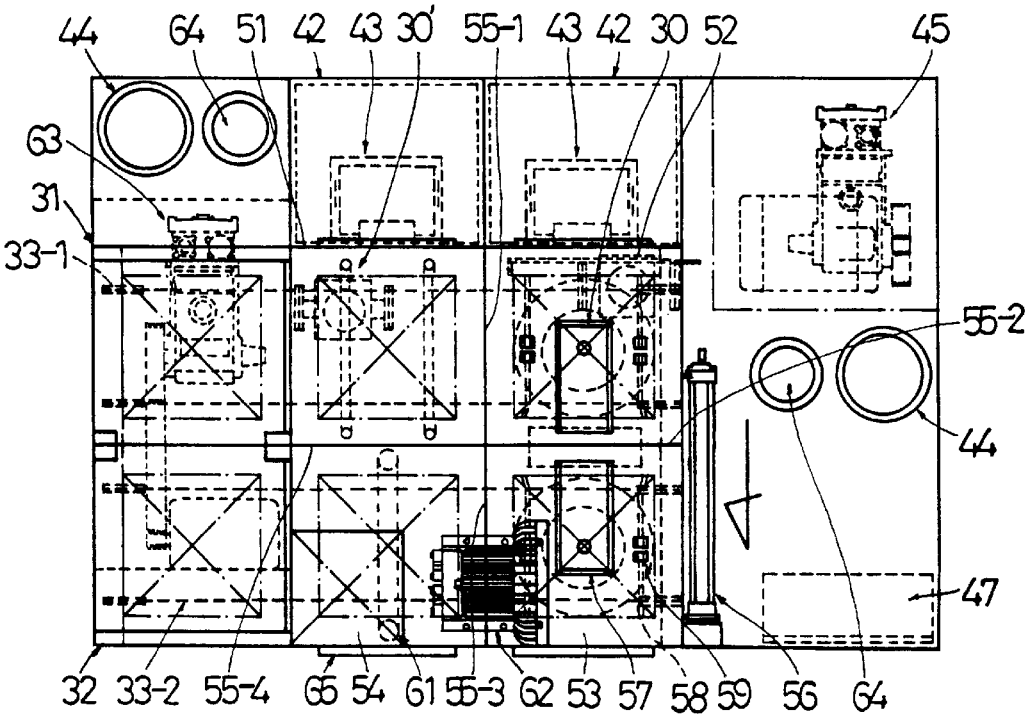
FIG. 5 is a plan showing a second embodiment of an aerial washing device according to this invention.
Figure 6:
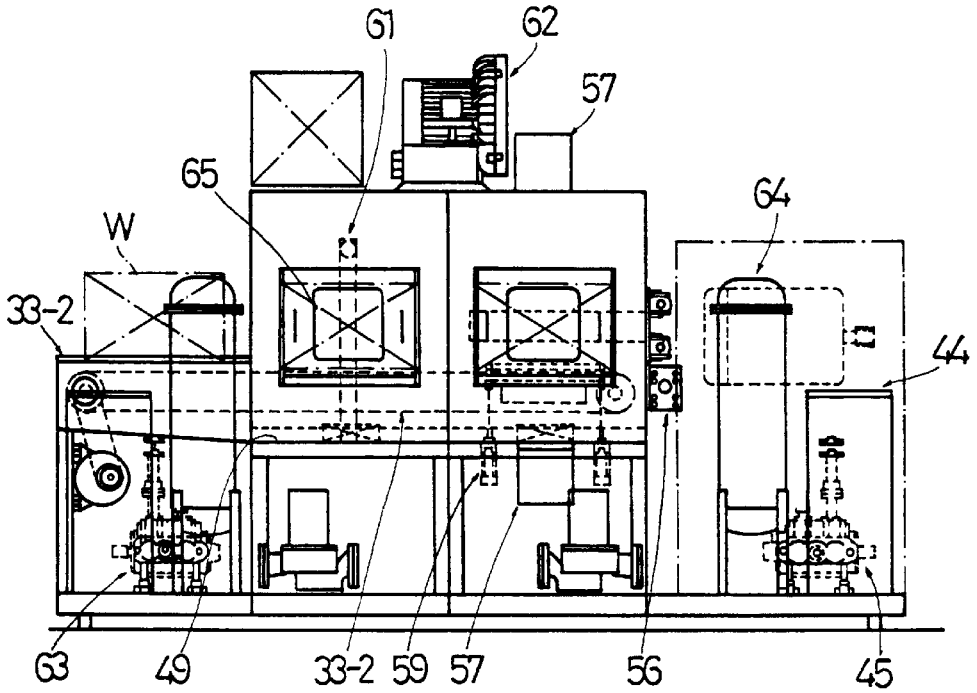
FIG. 6 is a front view of FIG. 5.
Figure 7:
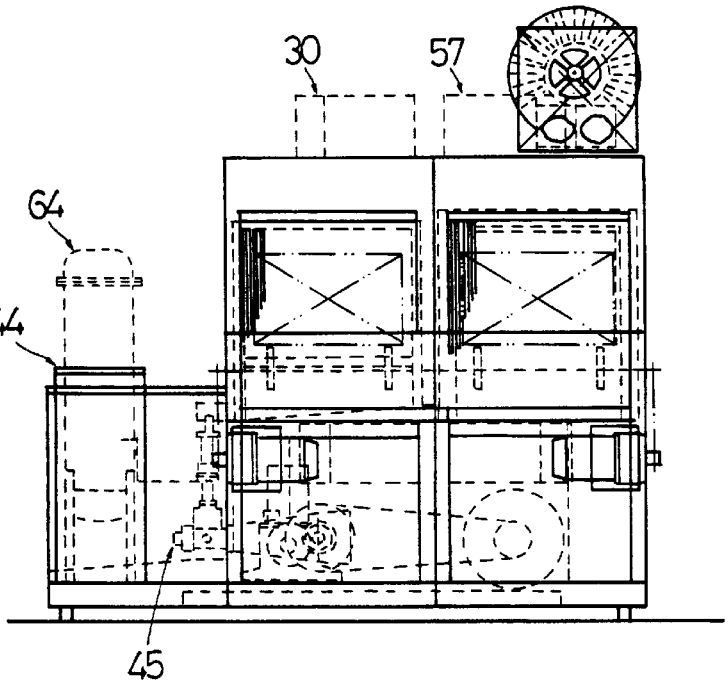
FIG. 7 is a left-side view of FIG. 5.

FIGS. 5, 6, and 7 shows a second embodiment of the aerial washing device according to this invention. This embodiment comprises a prewashing chamber 51, a production washing and finishing chamber 52, a dewatering chamber 53, and a drying chamber 54. The object moves through the chambers 51 to 54 in this order by means of a moving mechanism 56 comprising transfer mechanisms 33-1 and 33-2, which are similar to those described above, and a moving cylinder. Closing partitions 55-1, 55-2, 55-3, and 55-4 are provided between the chambers, and the required partitions are opened and closed before and after each operation.

As nozzles for implementing the washing method according to this invention, the fixed nozzle 30' is provided in the prewashing chamber 51, and the rotary washing nozzles 30 are provided on the top and bottom of the production washing and finishing chamber 52. Reference numeral 57 denotes a dewatering and drying rotary nozzle provided on the top and bottom of the dewatering chamber and which jets dry air instead of a washing liquid.

In the figures, 58 is a rail for moving the object through the moving mechanism 56; 59 is an elevating mechanism for supporting the rail and elevating and lowering the object to cancel the support; and 61 is a fixed nozzle for the drying chamber which jets warm air from an upper blower with a heat exchanger 62. Reference numeral 63 indicates a high-pressure pump for the prewashing chamber which is used to jet a high-pressure jet of water from the fixed nozzle 30' according to this invention. Reference numerals 64 and 65 denote a bag filter and an inspection door, respectively. The remaining components are similar to the corresponding components in the first embodiment, so the same reference numerals are used and descriptions omitted.

In the aerial washing device according to the second embodiment, once an object (for example, a mechanical part to be prewashed for subsequent electronic beam welding) in a basket has been supplied to the transfer path, it is prewashed in the prewashing chamber 51 with a high-pressure jet of water from the fixed nozzle 30', and then washed again in the production washing and finishing chamber 52 with a high-pressure jet of water from the rotary washing nozzles 30. The effects of this aerial washing is similar to those described above. The way of implementing the production washing are the same as that of doing the finishing (washing), and as soon as the aerial washing has been completed, the object is subjected to a vertical air blow from the rotary nozzle 57 in the dewatering chamber 53, and then completely dried by warm air jetted from the fixed nozzle 61. The object is not limited to such small objects as may be accommodated by the basket. Objects for washing may also be directly washed without a basket.

The aerial washing method according to this invention produces the most significant effects when a balance is achieved between the pressure applied to the high-pressure water and the amount of water supplied. For example, the best effects can be obtained when low-pressure water is supplied at Y liters per minute to high-pressure water maintained at a pressure of X kg/cm$^2$. When this former amount is smaller than Y liters, the high-pressure water fails to have a sufficient washing capacity due to an insufficient water supply. When the amount is larger than Y liters, the effects are also inadequate because the energy of the high-pressure water is small relative to its weight. Therefore, optimal washing effects can be obtained by adjusting the pressure and amount of water so that the best effects can be obtained in the central washing region A.

Due to the above configuration and effects, this invention eliminates the need for a water tank for immersing objects in washing water and thus for a watertight structure, therefore substantially reducing expenses. And despite the use of aerial washing, this invention can direct a high-pressure jet of water against objects to form around the outer circumference of the central washing region A a peripheral washing region B provides interfacial floating effects in order to increase over all washing performance by about 50%, thereby producing washing effects equal to those of underwater washing methods.

We claim:

1. An aerial washing method for washing an object set in an aerial washing position with a washing liquid mainly comprising water, said method comprising:

jetting a fluid comprising a mixture of a washing liquid and a gas against the object through washing nozzles by having a high-pressure water jet opening in a nozzle port of the washing nozzle and using a high-pressure jet of water to generate a negative pressure in the nozzle port and using the negative pressure to suck low-pressure water and a gas into the nozzle port through inlets for low-pressure water and a gas which are opened in the nozzle port, thereby engulfing the low-pressure water and the gas in said high-pressure water jet to form a high-pressure jet of water including the low-pressure water and the gas and directing the high pressure jet of water against the object.

2. An aerial washing method according to claim 1, wherein washing water is sprayed against an object as a shower so that the washing water will be engulfed in high pressure jet water, which will then be forcibly jetted against the object.

3. An aerial washing method according to claim 1, wherein a jet angle of the high-pressure jet of water is changed relative to the object by shifting one of the jet position or the jetted part of the object is changed at rapid intervals.

4. An aerial washing device for washing an object set in an aerial washing position by jetting against the object a washing liquid mainly comprising water so as to jet a liquid comprising a mixture of the washing liquid and a gas against the object, said device comprising a high-pressure jet pipe installed in a nozzle port of at least one washing nozzle and having a jet opening for jetting high-pressure water in a direction generally parallel to a direction of a nozzle axis to apply a negative pressure within the nozzle port; and inlets for low-pressure water and a gas respectively provided in the washing nozzle through which low-pressure water and a gas are drawn into said nozzle port maintained at the negative pressure.

5. An aerial washing device according to claim 4, wherein washing nozzles are attached to tips of a plurality of high-pressure water jet pipes radially extending around a rotation shaft, which is also used as a high-pressure water supply path, wherein a low-pressure water inlet is opened at a rear end of the washing nozzle with a low-pressure water passage leading to said inlet, connected to a low-pressure water supply path provided in the rotation shaft, and wherein a gas inlet for sucking air into the nozzle portion using negative pressure is opened in the washing nozzle.

6. An aerial washing device according to claim 5, having located at least on a top surface a rotary washing nozzle that directs a high-pressure jet of water against an object set in a washing chamber while simultaneously rotating.

* * * * *